US005777531A

United States Patent [19]

Tran et al.

[11] Patent Number: 5,777,531

[45] Date of Patent: Jul. 7, 1998

[54] SEMICONDUCTOR COPLANAR WAVEGUIDE PHASE SHIFTER

[75] Inventors: James Minh Tran; Choon Sae Lee, both of Dallas, Tex.

[73] Assignee: Texas Instruments Incorporated, Dallas, Tex.

[21] Appl. No.: 670,485

[22] Filed: Jun. 26, 1996

[51] Int. Cl.[6] ..... H01P 9/00

[52] U.S. Cl. ..... 333/164; 333/161

[58] Field of Search ..... 333/161, 164

[56] References Cited

U.S. PATENT DOCUMENTS

| | | | |
|---|---|---|---|
| 4,460,880 | 7/1984 | Turner | 333/161 |
| 4,630,011 | 12/1986 | Neidert et al. | 333/164 |
| 4,675,624 | 6/1987 | Rosen et al. | 333/247 X |
| 5,481,232 | 1/1996 | Wu et al. | 333/161 |

OTHER PUBLICATIONS

Jäger, Dieter; "Nonlinear Slow-Wave Propagation on Periodic Schottky Coplanar Lines"; *IEEE 1985 Microwave and Millimeter-Wave Monolithic Circuit Symposium; Digest* of Papers (Cat. No. 85CH2191-5): pp. 15-17; editor; M. Cohn; Publisher: IEEE, New York; Conference: St. Louis, Jun. 3-4, 1985.

*Primary Examiner*—Robert Pascal
*Assistant Examiner*—Barbara Summons
*Attorney, Agent, or Firm*—Alan K. Stewart; W. James Brady, III; Richard L. Donaldson

[57] ABSTRACT

A phase shifter transmission line includes a semiconductor layer 20; a first conductor region 42 on the semiconductor layer 20; a first doped region 24 and 30 in the semiconductor layer adjacent the first conductor region; and a variable bias voltage coupled to the first conductor region 42 for varying an effective dielectric constant in the transmission line.

2 Claims, 1 Drawing Sheet

SEMICONDUCTOR COPLANAR WAVEGUIDE PHASE SHIFTER

FIELD OF THE INVENTION

This invention generally relates to semiconductor devices. More specifically, the invention relates to semiconductor coplanar waveguide phase shifters.

BACKGROUND OF THE INVENTION

Phase shifters are an important component in phased-array antennas. Ferrite phase shifters have been extensively used in phased arrays because their weight is low and their size is small. However, their extremely high cost has prevented more widespread use. Recently ceramic phase shifters have drawn much attention in the antenna community because of their relatively low costs and reliable performances. The ceramic materials, however, have very high dielectric constants, thus causing a complex impedance-matching problem.

SUMMARY OF THE INVENTION

Generally, and in one form of the invention, the phase shifter transmission line includes a semiconductor layer; a first conductor region on the semiconductor layer; a first doped region in the semiconductor layer adjacent the first conductor region; and a variable bias voltage coupled to the first conductor region for varying an effective dielectric constant in the transmission line.

BRIEF DESCRIPTION OF THE DRAWINGS

In the drawings.

Corresponding numerals and symbols in the different figures refer to corresponding parts unless otherwise indicated.

DETAILED DESCRIPTION OF PREFERRED EMBODIMENTS

Figure 1:
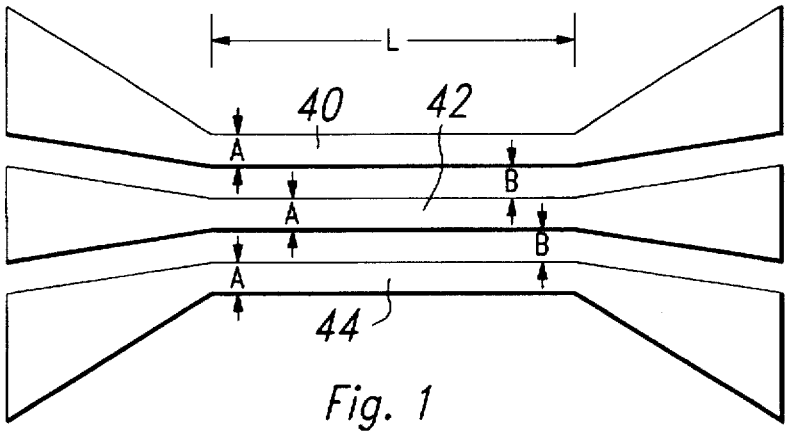
FIG. 1 is a top view of the preferred embodiment phase shifter.
Figure 2:
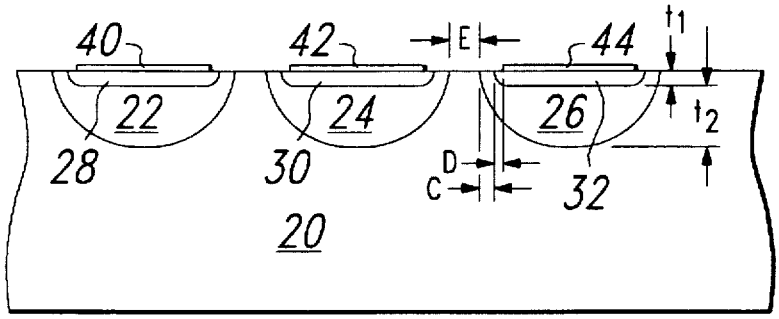
FIG. 2 is a cross-sectional view of the preferred embodiment phase shifter.

FIG. 1 is a top view of a preferred embodiment semiconductor phase shifter. FIG. 2 is a cross-sectional view of the device of FIG. 1. The device shown in FIGS. 1 and 2 includes semiconductor layer (P type substrate) 20, doped regions (N type) 22, 24, and 26, and doped regions (P type) 28, 30, and 32, and conductor regions 40, 42, and 44. The preferred embodiment phase shifter of FIGS. 1 and 2 is a coplanar waveguide transmission line with a semiconductor substrate 20. The propagation speed of the signal in the transmission line depends on the effective dielectric constant of the doped regions and the semiconductor layer. A phase shift is achieved by varying the propagation speed of the signal.

The doped regions 22, 24, 26, 28, 30, and 32 and the substrate 20 are doped to give at least one reverse-biased p-n junction for either polarization of a bias voltage applied across conductor regions 40, 42, and 44. A phase shift is achieved by varying the effective dielectric constant of the semiconductor layer and doped regions by varying the bias voltage. As the external field strength created by the bias voltage increases, the depletion regions become larger at the reverse-biased regions. This, in turn, changes the effective dielectric constant of the semiconductor layer and doped regions. The change of the propagation constant of the transmission line due to the applied bias voltage is given by the following equation:

$$d\beta = \frac{\omega^2 \iint \mu \delta \epsilon |u|^2 ds}{\beta \iint |u|^2 ds}$$

where the integration is over the cross-sectional area, $\delta\epsilon$ is the change of the permittivity in the propagating medium due to the external bias voltage, $\mu$is the permeability, and $\omega$and $\mu$are the angular frequency and the electric field of the propagating signal, respectively. Since most contribution to the integration comes from the region where the electric field u is strongest, the above equation is approximated to be:

$$d\beta = \frac{\omega^2 \mu \delta \epsilon_m |u_m|^2 \Delta\tau}{\beta \iint |u|^2 ds}$$

where the subscript m indicates the maximum field strength, and $\Delta\tau$ is the approximate area of the large electric field. The change of the depletion width of a reverse-biased p-n junction between two parallel plates is given by:

$$dw = w_0 \left( \sqrt{1 + \frac{\delta}{v_0}} - 1 \right)$$

where $w_0$ is the depletion width with a zero bias voltage, $\delta$ is the applied DC voltage across the junction and $V_0$ is the contact potential. Combining the previous two equations, the change in phase is given approximately by:

$$d\phi = a(\sqrt{1 + bv} - 1)$$

where a and b are constants, and v is the applied DC potential of the center microstrip line 42 relative to the ground potential of the outer microstrip lines 40 and 44. In general, these constant values are difficult to evaluate. For the results shown in FIG. 3, a and b were determined empirically by taking the first two experimental points at a low DC bias voltage.

Figure 3:
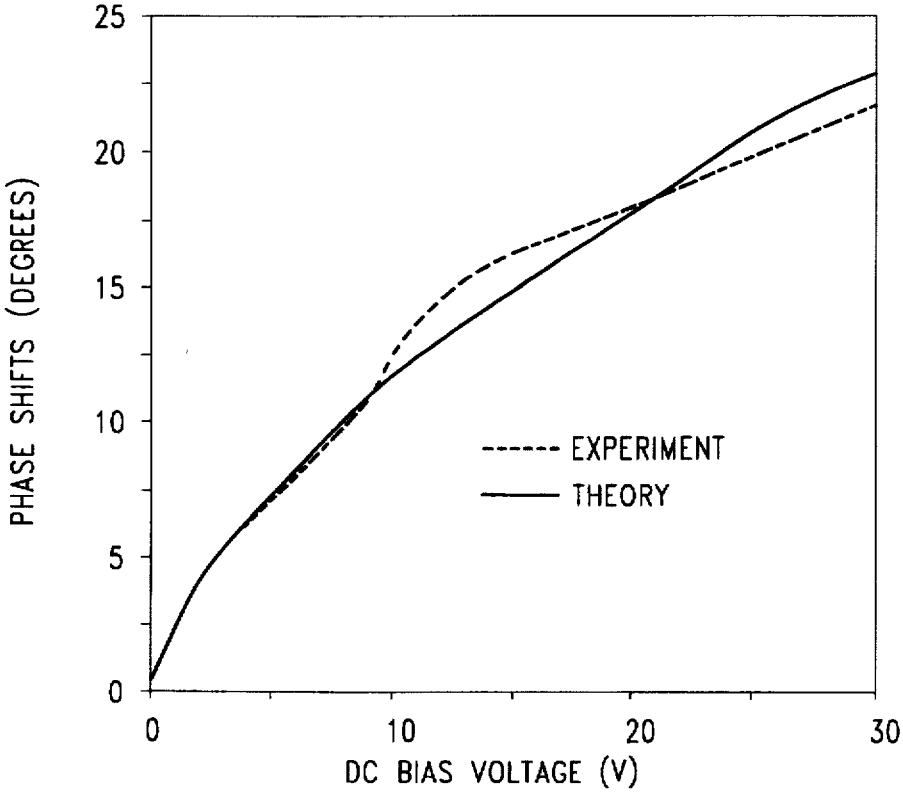
FIG. 3 is a diagram of the phase shift of the experimental data and the theoretical data vs. DC bias voltage.

For the experimental data shown in FIG. 3, the phase shifter shown in FIGS. 1 and 2 was fabricated on a six inch <100> Si wafer using a 2 micron process. The physical characteristics of the experimental phase shifter are A=25 μm, B=29 μm, C=6.5 μm, D=3.5 μm, E=9 μm, L=6000 μm, $t_1$=1.7 μm, and $t_2$=2.8 μm. The doping levels are $3.0\times10^{17}$ $m^{-3}$ (P type) for doped regions 28, 30, and 32; $1.0\times10^{16}$ $M^{-3}$ (N type) for doped regions 22, 24, and 26; and $1.5\times10^{15}m^{-3}$ (P type) for semiconductor layer 20. The device, still on wafer, was characterized on an RF probe test station. The lower side of the substrate (semiconductor layer 20 in FIG. 2) was left floating while the propagation constants were measured. The two outer microstrips were grounded at both input and output ports through the RF probe. An RF source with a DC bias was applied at the input ports of the center microstrip line and the S parameters were measured at the output port, which was terminated with a 50 ohm load. By sweeping the frequencies, a matrix of S parameters was collected over a range of DC bias voltages.

A substantial phase shift is observed at a relatively low DC bias voltage. A phase shift of 3.5 degrees per one bias volt over one centimeter of propagation at 1 GHz was detected at a low DC bias field. FIG. 3 shows the experimental phase shift as a function of the applied DC voltage in comparison with the theoretical values at 1 GHz. A relatively good agreement is observed between theoretical values and the experimental data confirming the physical principle of the preferred embodiment phase shifter.

This type of phase shifter can be implemented into a monolithic circuit integrated with radiating microstrip patch elements. The preferred embodiment device is inexpensive to fabricate and easy to implement, especially in a monolithic environment. An attractive feature of the proposed device is that the DC bias current is extremely small and a high DC field can be applied without a dielectric breakdown.

While this invention has been described with reference to an illustrative embodiment, this description is not intended to be construed in a limiting sense. Various modifications and combinations of the illustrative embodiment, as well as other embodiments of the invention, will be apparent to persons skilled in the art upon reference to the description. It is therefore intended that the appended claims encompass any such modifications or embodiments.

What is claimed is:

1. A transmission line for varying the propagation speed of a signal comprising:

a semiconductor region of the first conductivity type;

conductor regions on the semiconductor region, the conductor regions form a coplanar transmission line;

first doped areas of a second conductivity type in the semiconductor region;

second doped areas of the first conductivity type adjacent the first doped areas and between the conductor regions and the first doped areas; and a variable bias voltage coupled to one of the conductor regions for varying a propagating speed of a signal in the transmission line.

2. The device of claim 1 wherein the conductor regions comprise a first conductor, a second conductor spaced apart from the first conductor, and a third conductor spaced apart from the first conductor such that the first conductor region is disposed between the second and third conductor regions.

* * * * *